United States Patent [19]

Suzuki et al.

[11] Patent Number: 4,943,794

[45] Date of Patent: Jul. 24, 1990

[54] MOLDED COIL AND MANUFACTURING METHOD THEREOF

[75] Inventors: Masato Suzuki; Tomio Mizutani, both of Tsurugashima-Machi, Japan

[73] Assignee: Toko Kabushiki Kaisha, Tokyo, Japan

[21] Appl. No.: 383,089

[22] Filed: Jul. 21, 1989

[30] Foreign Application Priority Data

Jul. 27, 1988 [JP] Japan ..... 63-187276

[51] Int. Cl.[5] ..... H01F 15/10; H01F 27/30

[52] U.S. Cl. ..... 336/192; 29/602.1; 336/136; 336/205; 338/324

[58] Field of Search ..... 336/96, 205, 192, 65, 336/136; 29/602.1; 338/275, 324, 333, 334; 264/272.19

[56] References Cited

U.S. PATENT DOCUMENTS 2,646,535 7/1953 Coggeshall et al. ..... 336/205

3,649,939 3/1972 Hildebrandt ..... 336/205 X

*Primary Examiner*—Thomas J. Kozma

*Attorney, Agent, or Firm*—Stevens, Davis, Miller & Mosher

[57] ABSTRACT

A molded coil directly connected face to face to a conductor pattern of a circuit board, for eliminating unnecessary dimensions for pulling out end parts of the coil as face-to-face connection terminals, comprises at least one coil arranged along a vertical direction in which the coil is extending and buried in a synthetic resin body, a lower end part of the coil bent in the resin body in a horizontal direction so as to be orthogonal with the vertical direction and exposed to the outside of the resin body and end parts except the lower end part of the coil exposed to the outside of the resin body parallel to the vertical direction and bent outside in the horizontal direction, to form a face-to-face connection terminal, respectively.

4 Claims, 2 Drawing Sheets

MOLDED COIL AND MANUFACTURING METHOD THEREOF

BACKGROUND OF THE INVENTION

1. Field of the Invention

The present invention relates to a structure and manufacturing method for lowering the height of a molded coil directly connected face to face to a conductor pattern of a circuit board.

2. Technical Background of the Invention and its Problem

FIG. 8 is a sectional view showing a conventional molded coil. A spiral coil 1 is buried in a synthetic resin body 2 and both end parts 3, 5 of the coil 1 are horizontally exposed as face-to-face connection terminals. Number 4 denotes a through hole to which a threaded core not shown in figures is screwed. A molded coil such as the one mentioned above requires dimensions A, B of the resin body 2 under the coil 1. Though the dimensions are essential for pulling out the end part under the coil 1 (the lower end part 3 as a terminal) from the resin body 2 to a lower side, unlike a spiral part of the coil 1, and do not directly relate to the characteristics of the coil itself.

FIG. 9 is a partially enlarged view showing the lower end part 3 when the coil 1 is molded. Since it is difficult to orthogonally bend a curved part 12 accurately when the spiral part of the coil 1 is bent downwards, if the dimension A is reduced, the curved part 12 will touch an edge 8 of a hole 7 of a metal mold 6 to which the lower end part 3 is inserted and engage with it by the pressure of the injected resin when molded. This frequently results in failure that the molded coil 12 cannot be disengaged from the metal mold 6 after molding.

FIG. 10 is a partially enlarged view showing the molded coil when the lower end part 3 of the molded coil 1 is bent horizontally. The dimension B is required as a space where a flat metal 10 is clamped to bend the lower end part 3 by clamping the flat metal 10 between a bottom face 9 and the lower end part 3 of the molded coil.

The dimensions A, B are, accordingly, essential only for pulling out the lower end part 3 of the coil 1 as the face-to-face connection terminal, and do not directly relate to the characteristics of the coil. It is therefore desirable to reduce them for lowering the height of the molded coil or increasing inductance in same height.

SUMMARY OF THE INVENTION

It is an object of the present invention to provide a molded coil and manufacturing method thereof in which the height of the molded coil can be lowered so as not to require unnecessary dimensions for pulling out end parts of the coil as face-to-face connection terminals.

The present invention comprises a molded coil and manufacturing method thereof that at least one coil is arranged along a vertical direction in which the coil extends and is buried in a synthetic resin body, an end part of the lowest coil is bent in the resin body in a horizontal direction so as to be orthogonal with the vertical direction and exposed to the outside of the resin body, while the other end part of the coil except the lower end part of the lowest coil, is exposed to the outside of the resin body parallel to the vertical direction and is bent in the horizontal direction at the outside, to form a face-to-face connection terminal, respectively.

DESCRIPTION OF THE PREFERRED EMBODIMENT

The embodiment of the present invention will now be described with reference to FIGS. 1, 2 and 3.

Figure 1:
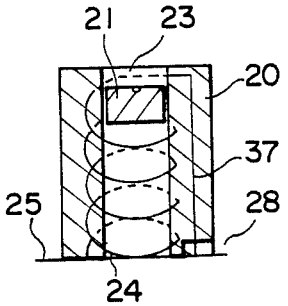
FIG. 1 is a sectional view of the molded coil according to the embodiment of the present invention.
Figure 2:
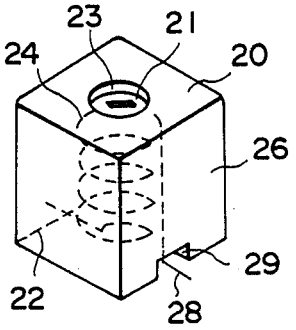
FIG. 2 is a perspective view.
Figure 3:
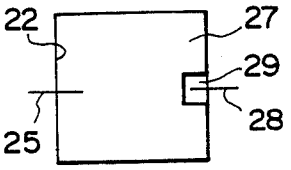
FIG. 3 is a bottom end view.

FIG. 1 is a sectional view, FIG. 2 a perspective view and FIG. 3 a bottom end view.

A through hole 23 to which a threaded core 21 is screwed, is arranged in the center of a synthetic resin body 20, while a coil 24 in which a wire spiral is buried in the resin body 20 surrounding the through hole 23.

A lower end part 25 of the coil 24 is bent in the resin body 20 in a horizontal direction so as to be orthogonal with a vertical direction in which a spiral part of the coil 24 extends and projects from one edge 22 where a side face 26 and a bottom face 27 of the resin body 20 are crossing each other, and its surface is exposed to the bottom face 27.

An upper end part 28 of the coil 24 projects from the bottom face 27 and is bent in a horizontal direction at the position at the same height as that of said lower end part 25 outside of the resin body 20.

The lower end part 25 and the end part 28 bent in the horizontal direction, both being exposed from the resin body 20, function as a face-to-face connection terminal, respectively.

The coil 24 comprises the almost spiral part, the lower end part 25 pulling out the lower side of the spiral part, the part 37 pulling out the upper side of the spiral part and extending in a vertical direction in the resin body 20 and furthermore, the end part 28 being a tip of the part 37 and located outside the resin body 20. Number 29 denotes a hollow part partially arranged along the other edge facing the edge 22.

The position of the end part 28 can be easily arranged to the same height as that of the lower end part 25, by exposing the end part 28 in the hollow part 29 and bending it in a horizontal direction.

Figure 4:
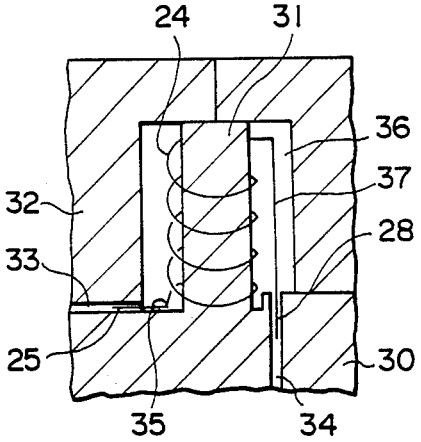
FIG. 4 is a sectional view of the metal mold showing the embodiment of the manufacturing method of the molded coil of the present invention.

FIG. 4 is a sectional view showing a mold metal when the molded coil is manufactured.

In a cavity 36, the spiral part of the coil 24 is engaged with a bar-shaped part 31 of a lower mold metal 30, the lower end part 25 bent in a horizontal direction is inserted in a hole 33 formed by the mold metal 30 and an upper mold metal 32, and resin molding is then performed with the condition that the end part 28 is inserted in a hole 34 of the mold metal 30.

Figure 5:
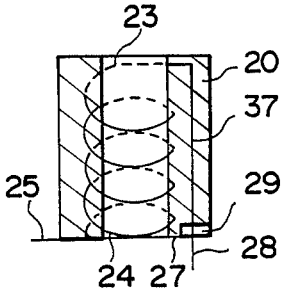
FIG. 5 is a sectional view of the molded coil during manufacturing.

The molded coil such as shown in a sectional view of FIG. 5 is formed accordingly. In the molded coil shown in FIG. 5, the lower end part 25 is bent in a horizontal direction, while the upper end part 28 projects into a bottom face 27 of the resin body 20 in the hollow part 29.

The direction in which the end part 28 projects, is parallel to a vertical direction in which the spiral part of the coil 24 extends. After that, the end part 28 is bent in a horizontal direction outside the resin body 20 such as is shown in FIG. 1.

Since the lower end part 25 is bent horizontally in the resin body 20, the molded coil in the present invention eliminates the dimension A for pulling out the lower end part 25 under the spiral part of the coil 24.

Figure 9:
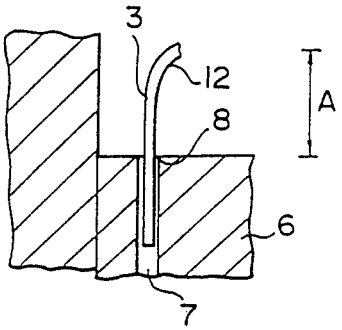
FIG. 9 PRIOR ART
FIGS. 9, 10 are partially enlarged views of an end part of a conventional molded coil when manufactured.
Figure 8:
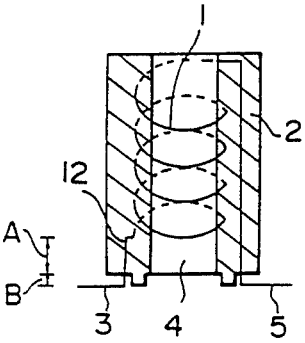
FIG. 8 PRIOR ART
FIG. 8 is a sectional view of a conventional molded coil.
Figure 10:
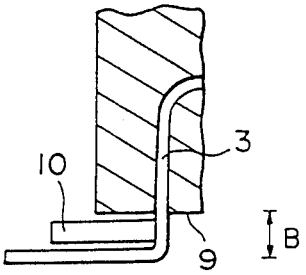
FIG. 10 PRIOR ART

Even if the bent part 35 of the lower end part 25 in a horizontal direction is not bent sufficiently such as the bent part 12 shown in FIG. 9, the edge of the hole 33 is not engaged with a bent part 35 of the lower end part 25, since the resin body 20 is thick in the horizontal direction.

The dimension B is also not required for bending the lower end part 25 in a horizontal direction outside the resin body 20.

In the manufacturing method for the molded coil in the present invention, the lower end part 25 of the coil 24 is bent in a horizontal direction in the cavity 36, while the end part 28 is molded as it extends in a vertical direction. Because the hole 34 is disposed, the end part 28 can also move vertically like the spiral part of the coil 24 if this somewhat stretches or contracts under pressure when resin is injected into the cavity.

Force applied to the coil 24 is then absorbed by vertical motion of the end part 28 in the hole 34.

The characteristics of the molded coil can therefore be prevented from varying from the designed characteristics, due to the deformation of the coil 24, at, such as, mainly the spiral part or the part where the spiral part and the end part 28 are connected to each other.

The deformation cannot be prevented if the end part 28 is first bent in a horizontal direction to be molded like the lower end part 25 is, because the force applied to the coil 24 by injecting resin cannot be absorbed.

Figure 6:
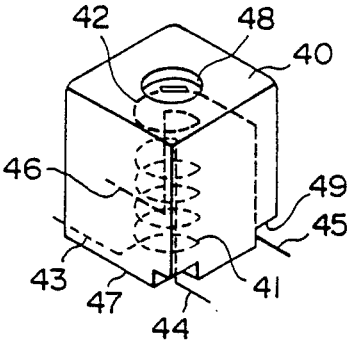
FIG. 6 is a perspective view of another embodiment of the molded coil.
Figure 7:
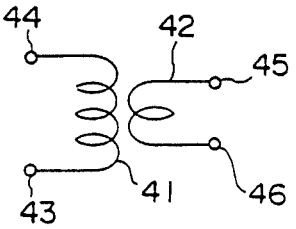
FIG. 7 is a connection diagram.

FIGS. 6 and 7 show another embodiment of the molded coil of the present invention. FIG. 6 is a perspective view and FIG. 7 is a connection diagram.

This molded coil comprises a transformer in which two coils 41 and 42 are buried in a resin body 40. The coils 41 and 42 are so disposed that the coil 42 is laid over the coil 41 along the vertical direction in which their spiral parts are extending.

A lower end part 43 of the coil 41 is bent in a horizontal direction in the resin body 40, while another end part 44 of the coil 41 and end parts 45, 46 of the coil 42 project from a bottom face 47 of the resin body 40, parallel to the vertical direction in which the end parts extend and are bent outside in the horizontal direction. Number 48 denotes a threaded core screwed to a through hole arranged in the center of the coils 41, 42, and number 49 a hollow part where the end part except the lower end part 43 is exposed.

A coil is easily deformed when molded if a molded coil is formed as a plural number of coils buried in a resin body such as mentioned above. Furthermore, precise relative position of each coil is required.

According to the manufacturing method already mentioned in this present invention, coils are prevented from being deformed and their relative positions are accurately maintained so that deviation from the designed characteristics is minimized.

Although the planar configuration of all molded coils in the embodiments is a quadrangle, it is not necessary to define it in this configuration, as circular or other configurations are also possible.

The coil may not completely buried, for example, as the spiral part may be partially exposed outside. Furthermore, the lower end part of the coil bent in a horizontal direction in the resin body may function as a face-to-face connection terminal as shown in the embodiments, but may also function in a way that it projects from a higher position of the side face of the resin body and is bent outside in step form or bent along the bottom face from the side face.

The end part except the lower end part may also be bent the same as the lower end part after it is exposed in a vertical direction.

The lower end part and other end parts may function as face-to-face connection terminals if they have parts extending in a horizontal direction outside the resin body. The end parts except the lower end part may be taps of the coil.

As mentioned above, the molded coil in the present invention is formed in a way that at least one coil is buried in the resin body, the end part of the lowest coil is bent in the resin body in a horizontal direction so as to be orthogonal with the vertical direction and exposed to the outside of the resin body, the end parts except the lower end part of the coil are exposed outside the resin body parallel to the vertical direction and bent outside in a horizontal direction, to form the face-to-face connection terminal, respectively.

The part of the resin under the position where the spiral part of the coil is buried is hardly necessary. This part is an excess dimension for pulling out the lower end part of the coil in the use of conventional coils.

Accordingly, in the molded coil in the present invention, its height can be lowered and an inductance larger than that of conventional ones can be obtained in same height.

Further, according to the manufacturing method of the molded coil in the present invention, the coil buried in the resin body is not deformed when molded, so that there is advantage that the characteristics of the coil do not vary greatly from the designed characteristics.

What is claimed is:

1. A molded coil comprising:

a coil arranged along at least one vertical direction in which the coil is extending and buried in a synthetic resin body, an end part of the coil bent in the resin body in a horizontal direction so as to be orthogonal with the vertical direction and exposed to the outside of the resin body, and the other end part of the coil exposed to the outside of the resin body parallel to the vertical direction and bent outside of the resin body in the horizontal direction, to form a face-to-face connection terminal, respectively.

2. A molded coil in accordance with claim 1, and further comprising:

a hollow part arranged to an edge where a bottom face and a side face of the resin body are crossing each other and the other end part of the coil exposed to the outside of the resin at the hollow part bent in a horizontal direction.

3. A molded coil comprising:

a plurality of coils arranged along a vertical direction in which the coils are extending and buried in a synthetic resin body, an end part of the lowest coil bent in the resin body in a horizontal direction so as to be orthogonal with the vertical direction and exposed to the outside of the resin body, and end parts of said plurality of coils except the end part of the lowest coil exposed to the outside of the resin body parallel to the vertical direction and bent outside of the resin body in the horizontal direction, to form a face-to-face connection terminal, respectively.

4. A molded coil in accordance with claim 3, and further comprising:

hollow parts arranged to edges where a bottom face and side faces of the resin body are crossing each other, and the end parts of said plurality of coils except said end part of the lowest coil exposed to the outside of the resin at the hollow parts bent in a horizontal direction.

* * * * *